US011533976B2

(12) United States Patent
Crisp

(10) Patent No.: US 11,533,976 B2
(45) Date of Patent: Dec. 27, 2022

(54) TWEEZERS HAVING DETACHABLE TIPS AND QUICK RELEASE MECHANISM

(71) Applicant: Cole Crisp, South Jordan, UT (US)

(72) Inventor: Cole Crisp, South Jordan, UT (US)

( * ) Notice: Subject to any disclaimer, the term of this patent is extended or adjusted under 35 U.S.C. 154(b) by 70 days.

(21) Appl. No.: 16/905,572

(22) Filed: Jun. 18, 2020

(65) Prior Publication Data

US 2021/0393015 A1 Dec. 23, 2021

(51) Int. Cl.
*A45D 26/00* (2006.01)
*B25B 9/02* (2006.01)

(52) U.S. Cl.
CPC ..... *A45D 26/0066* (2013.01); *B25B 9/02* (2013.01)

(58) Field of Classification Search
CPC ..... A45D 26/0066; B25B 9/02
See application file for complete search history.

(56) References Cited

U.S. PATENT DOCUMENTS 5,334,215 A * 8/1994 Chen ..... A61B 17/30 294/99.2
6,546,585 B1 * 4/2003 Blaustein ..... A46B 7/04 15/176.1
8,597,295 B2 * 12/2013 Kerr ..... A61B 18/1445 606/51
8,685,057 B2 * 4/2014 Wu ..... A61C 3/10 606/210
2004/0006357 A1 * 1/2004 Baldesberger ..... B25B 9/02 606/167
2009/0054925 A1 * 2/2009 Cho ..... A61B 17/30 606/210

* cited by examiner

*Primary Examiner* — Stephen A Vu
(74) *Attorney, Agent, or Firm* — Steven Rinehart

(57) ABSTRACT

Handheld tweezers having detachable tips interchangeable to optimally perform a variety of functions, personal and commercial. Examples of interchangeable tips may include flat slant tips, rounded tips, and point tip tweezers.

5 Claims, 5 Drawing Sheets

TWEEZERS HAVING DETACHABLE TIPS AND QUICK RELEASE MECHANISM

FIELD OF THE INVENTION

This invention relates to improvements in personal hygiene implements, and more particularly relates to tweezers, forceps, pincers, tongs, and gripping implements having detachable tips.

BACKGROUND

Description of the Related Art

Tweezers consist of small pronged instruments used for gripping, pinching and manipulating objects too small to be handled effectively. Tweezers are commonly used in grooming and personal hygiene, for everything from plucking hairs to removing slivers/splinters; but, also commonly used in commercial settings for things like placing washers and handling small transistors during electrical repair.

The prongs forming tweezers (also called levers) are typically connected and fused at a fulcrum point on a proximal ends of the tweezers. These prongs are often pinched together in the same manner that a writing instrument is gripped, using the gripping force of a user's finger to close the distal ends of the prongs over a desired object.

Tweezers come with a variety of tips adapted to perform certain functions. For instance, many tweezers come with a slanted flat tip adapted to pluck hairs using a mirror, in which the larger surface area on the slanted flat tips allows for some imprecision in positioning over a hair to be plucked. Slanted flat tip tweezers cannot easily be used to pluck a single hair from a group, however, often pinching too many hairs at once to be effective in targeting a single hair. Tweezers therefore also come with rounded tips, used to more effectively target a single hair and also used by surgeons for placing and pulling stitches and pinpointing smaller objections. Point tip tweezers can be used for piercing skin and removing slivers, but are not effective for use in a mirror. Arched-claw tweezers typically have tips (or claws) arched inwardly to increase visibility to a user peering within the tweezer prongs. There are also wide grip tweezers, used to increase the surface area exposed to a user's fingers. Wide grip tweezers are adapted to maximum gripping force at the tips. Although metal alloys, such as steel, are most commonly used in tweezer manufacturing, there are applications in which softer, polymeric materials are more ideal, such electrical applications in which non-conductive materials are required, or when using tweezers to handle extremely fragile objects, such of the pages of antiquarian books. In these applications, very blunt tips may be desired.

For users who commonly require a variety of tweezer tips, it can be expensive and cumbersome to purchase, store and maintain separate tweezers having each tip. For users who travel frequently and invest in their appearance, there is difficultly where travel space is limited. For other users who have very restricted room for personal effects, such as cadets at the Air Force Academy, there is an interest in making optimal use of personal space. In commercial settings, there is an interest in organization of tool boxes in restricted employee working space.

To conserve space and reduce expense, tweezers commonly available over the counter are made from weaker, smaller, cheaper materials than would otherwise be justifiable if only a single pair of tweezers were used for all applications. The net effect is that tweezers commonly used and purchased, and which proliferate on the open market, are nonoptimally weak and small.

Although some tweezers with interchangeable tips are known, these tweezers suffer from various inefficiencies in that they require unthreading multiple screws to interchange, or the tips do not stay on effectively. There is a need in the art for precision tweezers with interchangeable tips which do not suffer from the deficiencies inherent in the prior art. It is therefore an object of the present invention to provide a tweezers with quick release interchangeable tips.

SUMMARY

From the foregoing discussion, it should be apparent that a need exists for a tweezers having detachable tips and a release mechanism. Beneficially, such a device would overcome inefficiencies with the prior art by providing an effective means of securely and easily interchanging tweezer tips. The present invention has been developed in response to the present state of the art, and in particular, in response to the problems and needs in the art that have not yet been fully solved by currently available apparti. Accordingly, the present invention has been developed to provide a tweezers having detachable tips, the tweezers comprising: a first set of prongs comprising two first elongated prongs, the first elongated prongs affixed together using two or more bridges positioned substantially at a proximal terminal end of the first set of prongs, the first elongated prongs defining a track between them in which a second set of prongs travels; the second set of prongs comprising two second prongs fused at proximal end, the proximal end of the second set of prongs extending laterally and proximally beyond the proximal terminal end of the first elongated prongs, wherein the second set of prongs is adapted to travel within the track when the proximal second end is depressed; a plurality of detachable tweezer tips, each tweezer tip adapted to form a friction fit with distal end of a first elongated prong, each tweezer tip comprising a sidewall abutting a distal end of a second prong, the friction between the tweezer tip and prong released when second set of prongs travels within the track.

The first set of prongs may be formed as a single integrated piece. One or more of the detachable tips may comprise a slanted flat tip and a rounded tip.

A top surface of the second set of prongs may slide against a bottom surface of a first elongated prong.

The distal ends of the elongated first prongs may be tapered.

The distal ends of the elongated first may overhang and may extend laterally from the distal ends of the second prongs.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
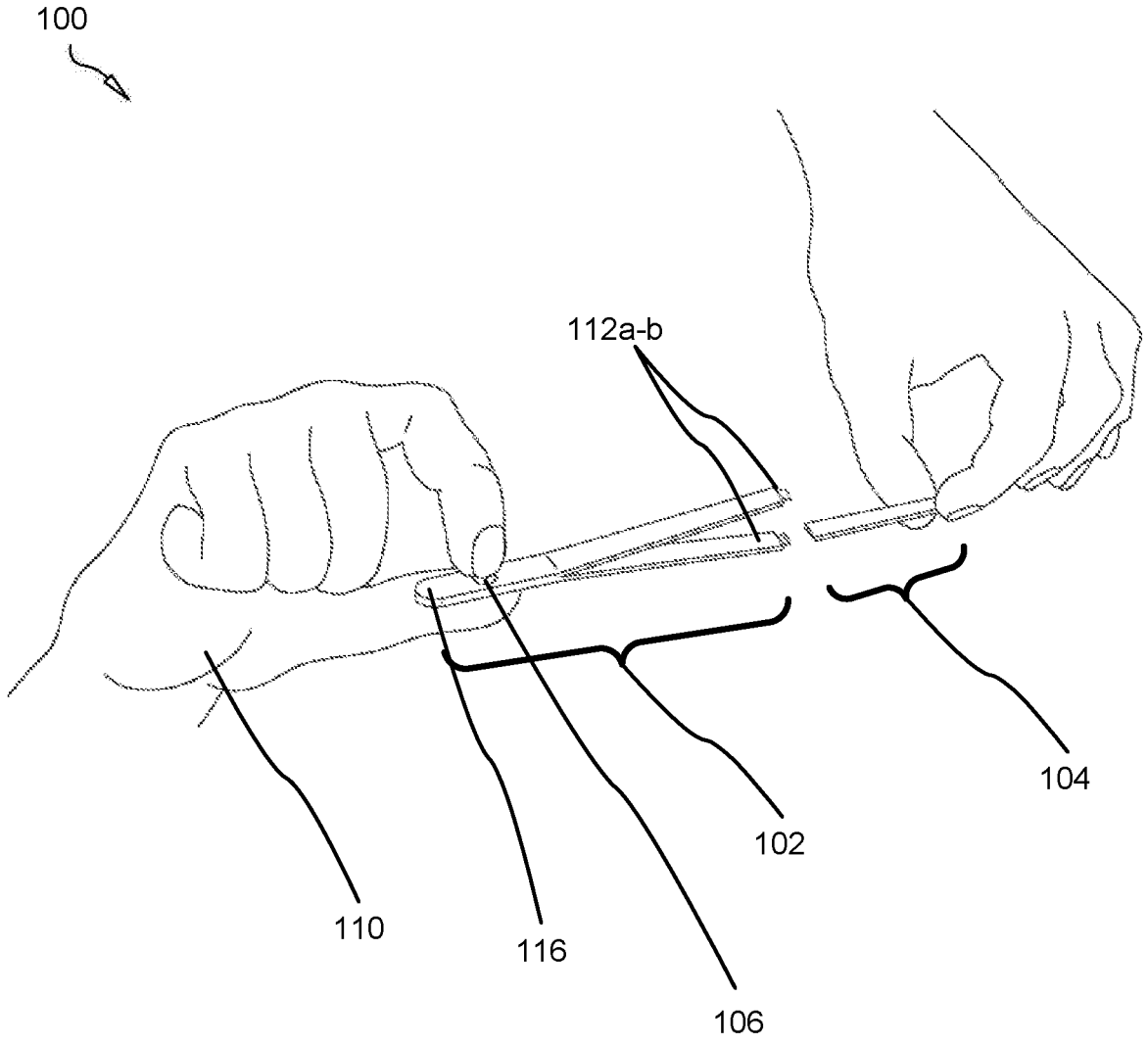
FIG. 1 is an environmental, isometric perspective view of tweezers having detachable tips and a quick release mechanism in accordance with the present invention.
Figure 2:
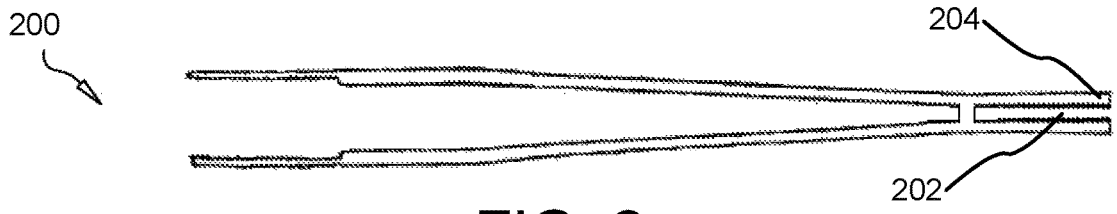
FIG. 2 is a top perspective view of tweezers having detachable tips and a quick release mechanism in accordance with the present invention.

FIG. 1 is an environmental, isometric perspective view of tweezers having detachable tips and a quick release mechanism 100 in accordance with the present invention.

The tweezers 100 comprise a pair of prongs 112*a-b* which are fused together at a proximal end 116 of the tweezers 100. The main body 102 of the tweezers 100 comprises the portion of the tweezers 100 which excludes to the tips 104*a-b*. Each tip 104 detachably affixed to the distal end of one of the prongs 112.

In various embodiments, a button 106 is depressed releasing the tips 104 from the prongs 112.

FIGS. 2-4 and 8-9 illustrate a top perspective view of tweezers 300 having detachable tips and a quick release mechanism in accordance with the present invention.

The tweezers 300 comprise two sets of prongs 200, 800. The first set of prongs 200 comprises prongs 112*a-b* which are connected together at the proximal end 116 but spaced apart using a spacer or bridge 310 to define a recess 202 between the prongs 112 (or a track between the prongs 112). The tweezers 300 may comprises a plurality of bridges 310. The first set of prongs 200 may be formed as a single integrated piece.

A second set of prongs 800 comprises prongs 308*a-b* positions within the recess 202. The prongs 308*a-b* are fused together at the proximal end 116. The second set of prongs 800 may likewise be formed as a single integrated piece.

The distal terminal end 302 of the second set of prongs 800 extends laterally beyond the distal terminal end 204 of the first set of prongs 200. When the distal terminal end of the second set of prongs 800 is depressed laterally, the second set of prongs 800 slides within the recess 202. The prongs 308 terminate at distal terminal ends 802 short of the full width of the prongs 112. A cantilevering portion 322 of the prongs 112 extends laterally in a distal direction away from the proximal end 116 beyond the terminal ends 802. The cantilevering portion 322 may be tapered. The cantilevering portions 322*a*, 322*b* are adapted to insert into a recess 324 on detachable tips 304*a-b*. The distal terminal end 302 may be blunted (across any or all axes or planes) to reduce pressure on fingers and prevent the distal terminal end 302 from sliding out of the tweezers 300. The distal terminal end 302 is shown rounded off across a lateral plane.

The detachable tips 304*a-b* comprise tips of tweezers. The detachable tips 304 may comprise a slanted flat tip 504, rounded tips 304, point tips, arched-claw tips, or wide grip tips. The tips 304, 504 may be fabricated from a rust-resistant metal alloy, such as steel, titanium 5, titanium 6, or softer polymeric materials, including nonconductive materials. The tips may be coated with padded polymeric material adapted to handle fragile objects, such of the pages of antiquarian books.

The detachable tips 304, 504 define a hollow interior recess 304 adapted to receive, and form a friction fit with, the cantilevering portion 322 of a prong 112. The tip 304*a* defines the hollow recess 324. The recess 324 is positioned closer to the top sidewall 802 than the bottom sidewall 304. The recess 324 may, or may not, be centrically disposed within the tip 304*a*.

In the shown embodiment, the lower sidewall 804 positions laterally to the distal terminal end 802 of the second set of prongs 800, such that when the second set of prongs 800 is pushed to travel within the first set of prongs 200, the distal terminal end 802 forces the tip 304*a* from the body of the tweezers 102.

The second set of prongs 800 may slide out completely from the first set of prongs 200. The top surface of the second set of prongs 800 slides against the bottom surface of prong 112*a*. The bottom surface of the second set of prongs 800 slide against the top surface of prong 112*b*.

Figure 3:
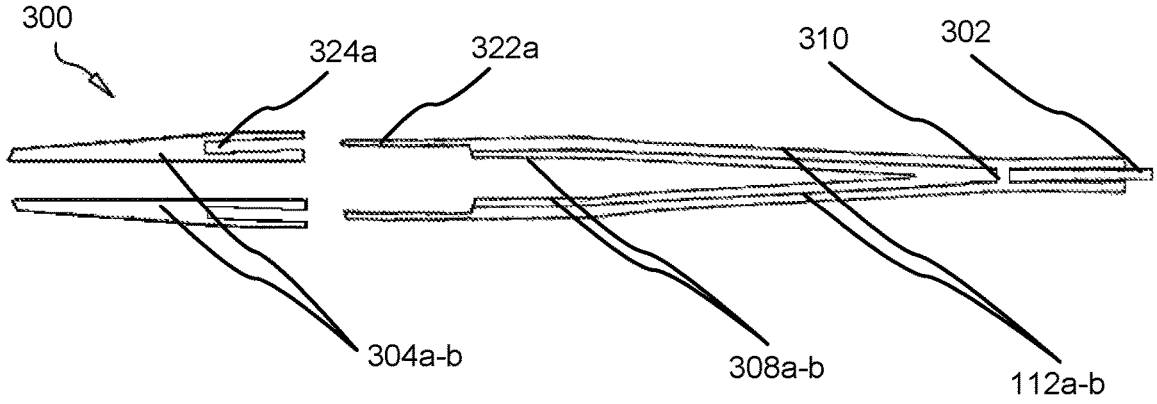
FIG. 3 is a top perspective view of a first set of prongs of tweezers having detachable tips and a quick release mechanism in accordance with the present invention.
Figure 4:
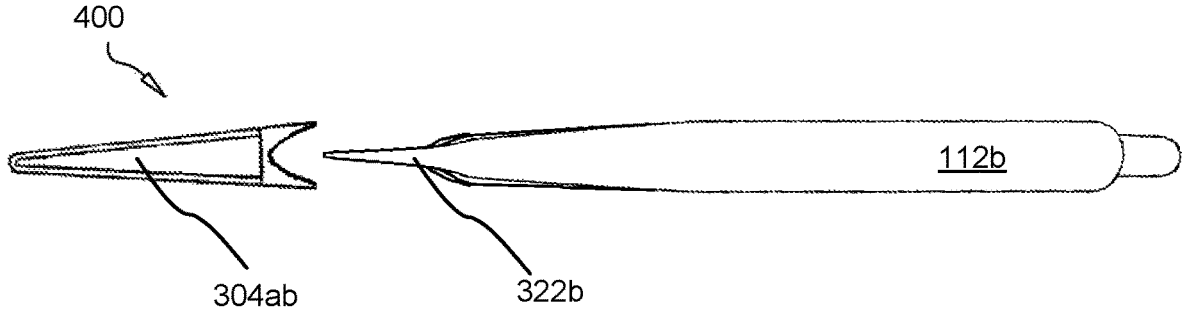
FIG. 4 is a side perspective view of tweezers having detachable tips and a quick release mechanism in accordance with the present invention.

When the tips 304 are slid onto the distal ends of the prongs 112, the sidewalls 804 push the second set of prongs back into the position shown in FIG. 3 (a closed configuration).

The second set of prongs 800 is Y-shaped. The first set of prongs 200 may be Y-shaped.

In some embodiments, the cantilevering portion 322 is affixed to the distal end of the prongs 308 in the second set 800 rather than the prongs 108 in the first set 200. In this embodiment, the first set of prongs 200 is adapted to push against the sidewall 802 and detach the tips 304 from the tweezers 300.

Figure 5:
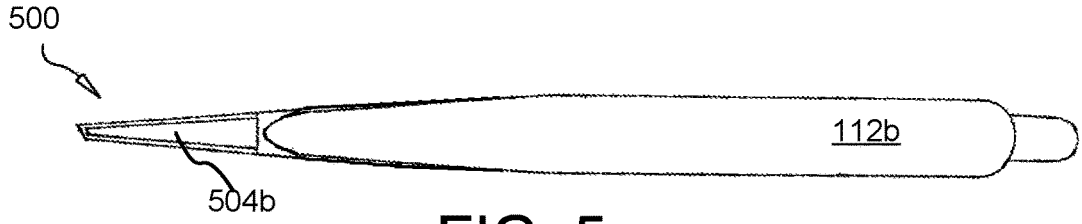
FIG. 5 is a side perspective view of tweezers having detachable tips and a quick release mechanism in accordance with the present invention.

FIG. 5 is a side perspective view of tweezers having detachable tips and a quick release mechanism 500 in accordance with the present invention.

The tip 504 is in a closed configuration, with the tip 504*b* forming a friction fit with the prong 112*b*.

Figure 6:
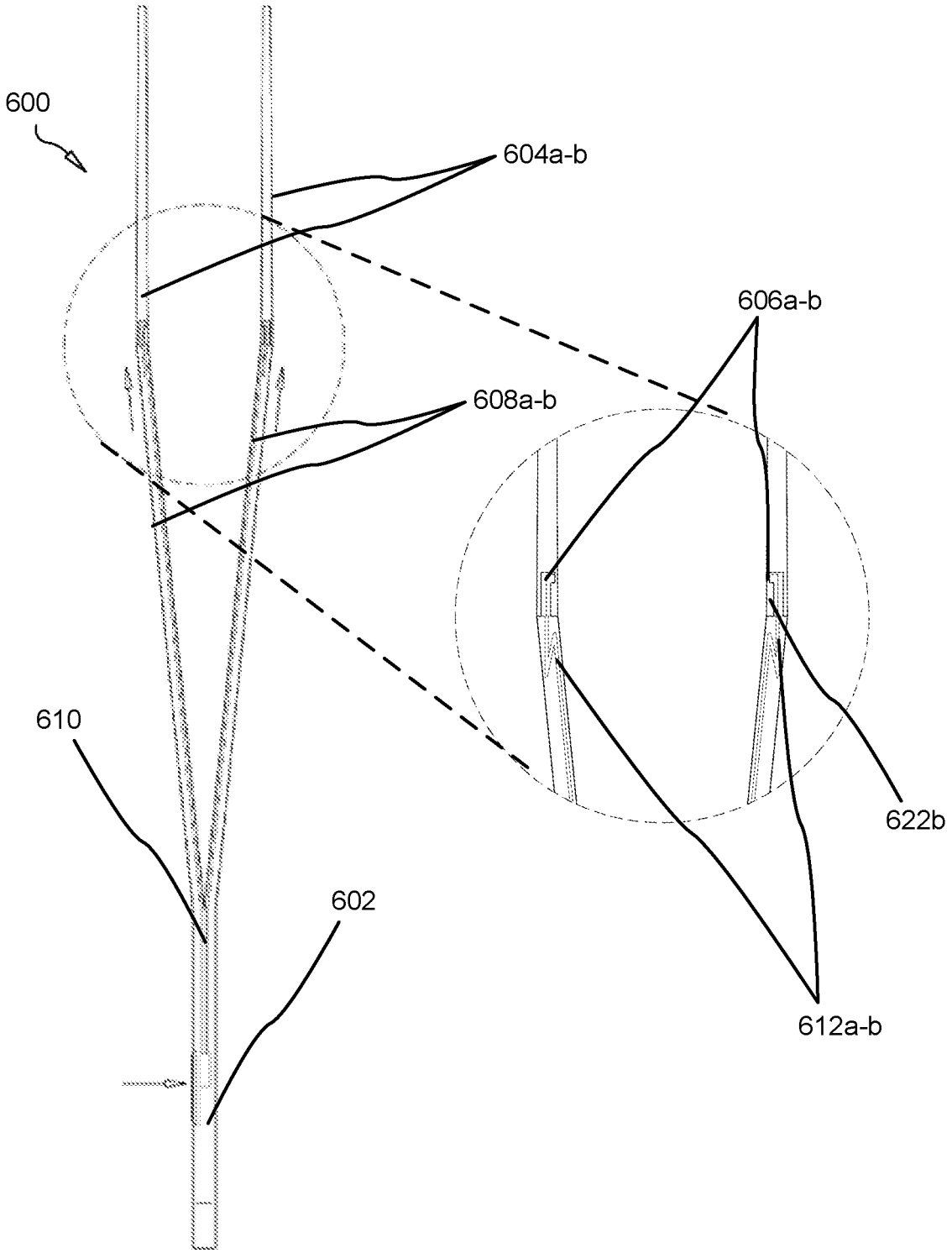
FIG. 6 is a sectioned top perspective view of tweezers having detachable tips and a quick release mechanism with an exploded view in accordance with the present invention.
Figure 7:
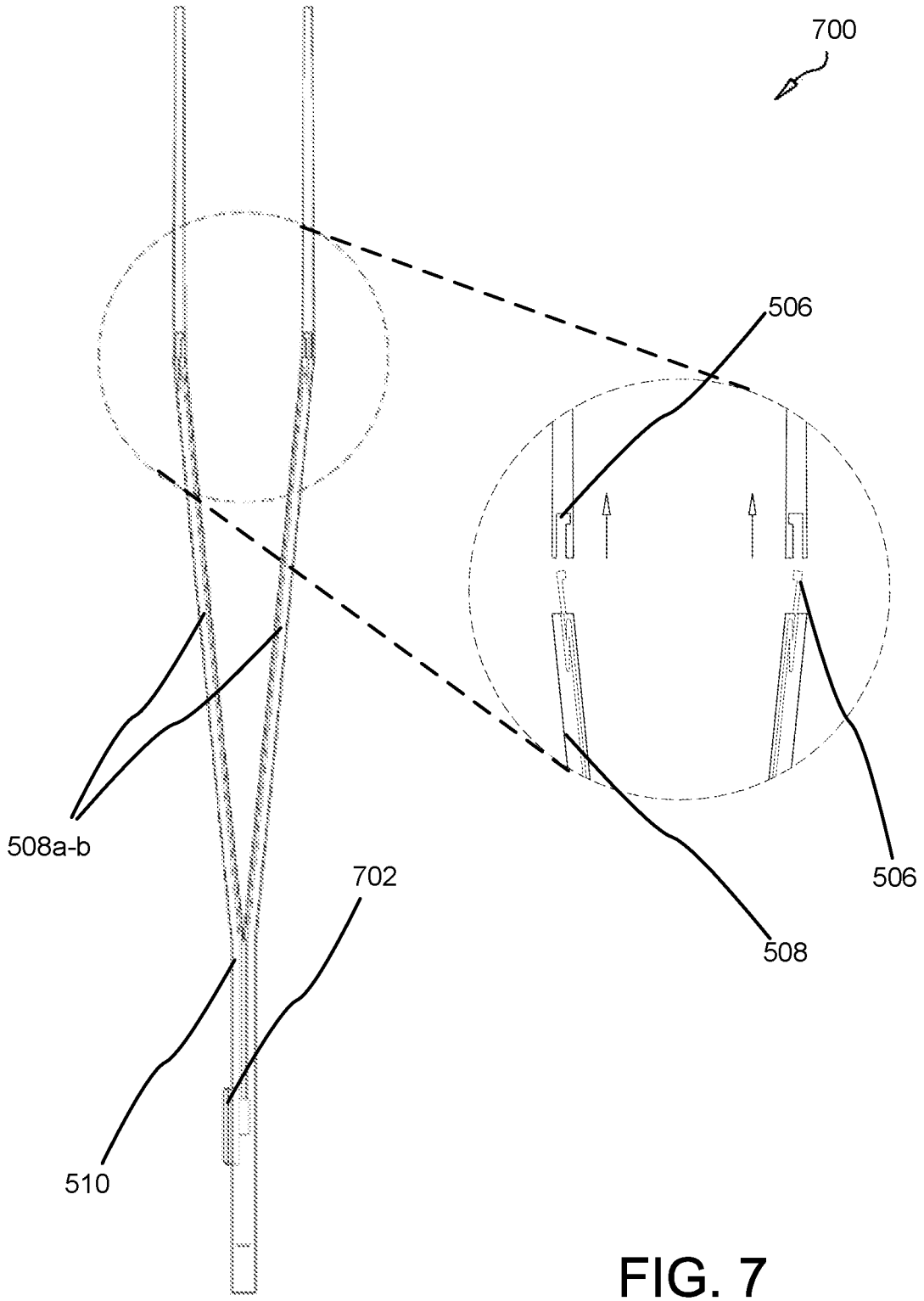
FIG. 7 is a sectioned top perspective view of tweezers having detachable tips and a quick release mechanism with an exploded view in accordance with the present invention.
Figure 8:
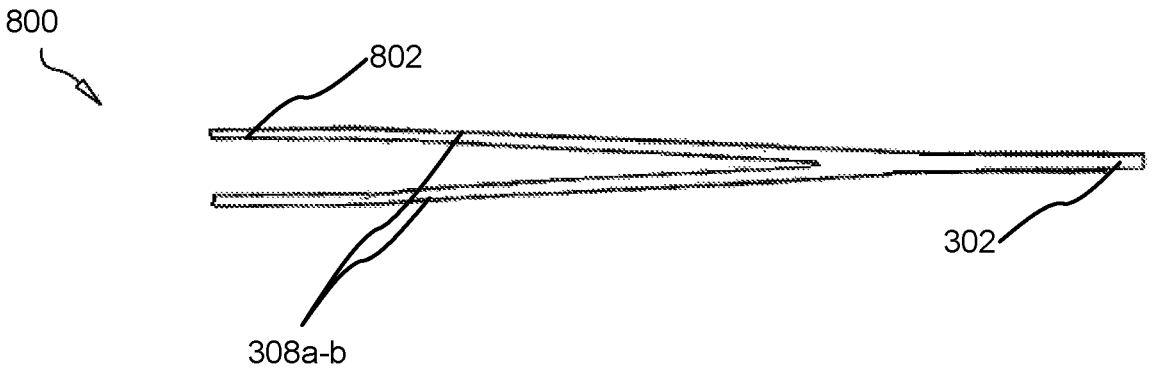
FIG. 8 is a top perspective view of tweezers having detachable tips and a quick release mechanism in accordance with the present invention.
Figure 9:
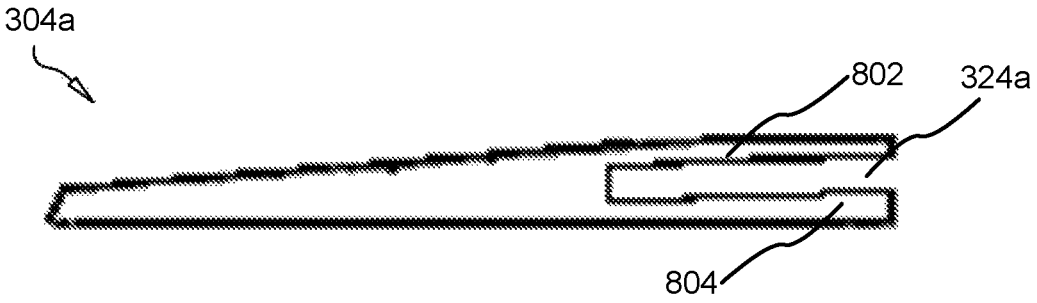
FIG. 9 is a top perspective view of a detachable tip of tweezers having detachable tips and a quick release mechanism in accordance with the present invention.

FIGS. 6-7 illustrate a sectioned a top perspective view of tweezers 600, 700 having detachable tips and a quick release mechanism 600 with an exploded view in accordance with the present invention.

The tips 604*a-b* are detachably affixed to the prongs 608*a-b* using hooks 606 or barbs 606 affixed to a control shaft 610. The control shaft 610 may be Y-shaped. The control shaft 610 travels within the prongs 608.

In various embodiments, the control shaft 610 folds back over itself at a folding point 612 as shown, such that when the control shaft 610 slides forward within the body 102 of the tweezers 600, 700 the hooks 606 open, releasing the tips 604.

In other embodiments, the control shaft 610 is hingedly affixed to the hooks 606. The control shaft 610 travels within a hollow interior recess defined by the prongs 508.

The hooks 606 may catch, or snag, a sidewall 622 of the tip 604. The hook may close into a recess defined distally (or above) the sidewall 622.

In various embodiments, the control shaft 510 comprises to flat or cylindrical elongated shafts abutting one another. The control shaft 510 may be slid forward with a button 702, or latch 702.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. Tweezers having detachable tips, the tweezers comprising:

a first set of prongs comprising two first elongated prongs, the first elongated prongs affixed together using two or more bridges positioned substantially at a proximal terminal end of the first set of prongs, the first elongated prongs defining a track between them in which a second set of prongs travels;

the second set of prongs comprising two second prongs fused at proximal end, the proximal end of the second set of prongs extending laterally and proximally beyond the proximal terminal end of the first elongated prongs, wherein the second set of prongs is adapted to travel within the track when the proximal second end is depressed;

a plurality of detachable tweezer tips, each tweezer tip adapted to form a friction fit with a distal end each of the first elongated prongs, each tweezer tip comprising a sidewall abutting a distal end of each of the second prongs, the friction fit between the tweezer tip released when the second set of prongs travels within the track, wherein a top surface of the second set of prongs slides against a bottom surface of each of the first elongated prongs.

2. The tweezers of claim 1, wherein the first set of prongs is formed as a single integrated piece.

3. The tweezers of claim 1, wherein one or more of the detachable tips comprises a slanted flat tip and a rounded tip.

4. The tweezers of claim 1, wherein the distal ends of the elongated first prongs are tapered.

5. The tweezers of claim 1, wherein the distal ends of the elongated first set of prongs overhang and extend laterally from the distal ends of the second prongs.

* * * * *